US006457612B1

(12) United States Patent
Zhang et al.

(10) Patent No.: US 6,457,612 B1
(45) Date of Patent: Oct. 1, 2002

(54) SEALABLE AND MANIPULABLE PRE-FILLED DISPOSABLE PIPETTE

(75) Inventors: Jack Yongfeng Zhang, South El Monte, CA (US); Mary Zi-Ping Luo, South El Monte, CA (US); Frank Zhishi Xia, South El Monte, CA (US)

(73) Assignee: Amphastar Pharmaceuticals Inc., Rancho Cucamonga, CA (US)

( * ) Notice: Subject to any disclaimer, the term of this patent is extended or adjusted under 35 U.S.C. 154(b) by 0 days.

(21) Appl. No.: 09/975,126

(22) Filed: Oct. 12, 2001

(51) Int. Cl.[7] ..... A47G 19/14

(52) U.S. Cl. ..... 222/465.1; 222/107; 422/100; 422/99; 73/863.32; 73/864.01; 73/864.53

(58) Field of Search ..... 222/465.1, 107; 422/100, 99; 73/863.32, 864.01, 864.02, 864.11, 864.53

(56) References Cited

U.S. PATENT DOCUMENTS

| | | | | | |
|---|---|---|---|---|---|
| 2,180,063 | A | * | 11/1939 | McKinley | 128/231 |
| 3,045,494 | A | * | 7/1962 | Gerarde | 73/425.6 |
| 3,128,920 | A | * | 4/1964 | Volckening et al. | 222/215 |
| 3,757,781 | A | * | 9/1973 | Smart | 128/223 |
| 3,785,366 | A | * | 1/1974 | Davis | 128/2 B |
| 3,905,768 | A | * | 9/1975 | Hach | 23/230 |
| 3,938,392 | A | * | 2/1976 | Rorigues | 73/425.6 |
| 3,951,313 | A | * | 4/1976 | Coniglione | 222/186 |
| 3,991,758 | A | * | 11/1976 | Mohrke et al. | 128/233 |
| 3,993,223 | A | * | 11/1976 | Welker, III et al. | 222/107 |
| 4,003,262 | A | * | 1/1977 | Gerarde et al. | 73/425 |
| 4,052,986 | A | * | 10/1977 | Scaife | 128/260 |
| 4,124,044 | A | * | 11/1978 | Nugent | 141/98 |
| 4,248,227 | A | * | 2/1981 | Thomas | 128/232 |
| 4,563,104 | A | * | 1/1986 | Saint-Amand | 401/139 |
| 4,779,768 | A | * | 10/1988 | St. Amand | 222/209 |
| 5,048,727 | A | * | 9/1991 | Vlasich | 222/209 |
| 5,073,347 | A | * | 12/1991 | Garren et al. | 422/100 |
| 5,226,572 | A | * | 7/1993 | Gargione | 222/214 |
| 5,261,881 | A | * | 11/1993 | Riner | 604/110 |
| D347,277 | S | * | 5/1994 | Snedden | D24/115 |
| 5,538,506 | A | * | 7/1996 | Farris et al. | 604/187 |
| 6,241,124 | B1 | * | 6/2001 | Hoyt | 222/143 |
| 6,343,717 | B1 | * | 2/2002 | Zhang et al. | 222/209 |
| 6,357,626 | B1 | * | 3/2002 | Zhang et al. | 222/78 |

* cited by examiner

*Primary Examiner*—Henry C. Yuen
*Assistant Examiner*—Frederick C. Nicolas
(74) *Attorney, Agent, or Firm*—Albert O. Cota

(57) ABSTRACT

An improved pre-filled disposable pipette (10) consisting of a hollow tube (12) dimensioned to enclose a medicinal product and having attached a medication transfer tube (22) from where the pipette is filled and the medicinal product released. The improvement consists in having a primary grasping tab (32) attached to an upper end (14) of the bulb (12); a secondary grasping tab (38) attached to each side of the tube (22); and a support tab (52) also attached to each side of the tube (22) near the lower end (26) of the tube (22). The primary and secondary grasping tabs (32, 38) allow the pipette (10) to be conveniently and easily handled without having to grasp the sensitive bulb (12) or to directly grasp the tube (22). The support tab (52) functions to allow the pipette (10) to be placed on a conveyor rack apparatus (88) from where the pipette (10) can be automatically filled and sealed by a cap (72) or heat applied foil (82).

22 Claims, 2 Drawing Sheets

SEALABLE AND MANIPULABLE PRE-FILLED DISPOSABLE PIPETTE

TECHNICAL FIELD

The invention pertains to the general field of pipettes and more particularly to a sealable and manipulable pre-filled, disposable pipette that is filled with a medicinal product, used once and discarded.

BACKGROUND ART

A typical pipette consists of a slender pipe or tube that is used to transfer or measure small quantities of a liquid or a gas from one location to another. The most common type of pipette consists of a small plastic tube that widens into a bulb at the middle or the end. Liquid may be sucked into the bulb and retained therein by closing the top end of the pipette with a stopper, thumb or the like. The currently used prior art pipettes inherently have the following problems:

1. Filling the pipettes with liquid medication is difficult due to the pipette's narrow opening and the tendency of the bulb to deform if improperly handled,
2. After the pipettes are filled any subsequent processing of the pipette is difficult, primarily because the bulb can be inadvertently deformed causing the liquid therein to flow out. In general, the current pipette designs do not include any grasping sections that allow pipettes to be conveniently handled. The bulb cannot be used as a grasping point because of its tendency to deform, and the remaining parts of the pipette are also not suitable for gasping because the mass center of a pre-filled pipette is centered on the bulb.
3. Many medications are required to be sealed. Due to the handling problem described above, the current pre-filled pipettes can not be adequately sealed. The problem described in item 1, has been addressed by the applicant in a previously filed patent application. The instant application provides a solution to the problems described in items 2 and 3.

A search of the prior art did not disclose any patents that read directly on the claims of the instant invention, however the following U.S. patents are considered related:

| U.S. Pat. No. | INVENTOR | ISSUED |
|---|---|---|
| 5,073,347 | Garren, et al | 17 December 1991 |
| 4,875,602 | Chickering, et al | 24 October 1989 |
| 4,563,104 | Saint-Amand | 7 January 1986 |
| 4,483,825 | Fatches | 20 November 1984 |

The U.S. Pat. No. 5,073,347 patent discloses a volumetric pipette for dispensing liquids. The pipette is formed as a unitary structure made of components which are bonded together to create a precision fluid dispensing device. The pipette includes a stem portion which is separately formed and which is bonded to a bulb portion to complete the pipette.

The U.S. Pat. No. 4,875,602 patent discloses a liquid dispensing apparatus, which includes a self-contained source of fluid normally, isolated within a reservoir bulb. The bulb is deformed to initially rupture a membrane allowing the fluid to be forced through a shaft bore to saturate a tip-mounted swab. Alternatively, the membrane may be positioned intermediate two aligned sections of the shaft and is ruptured upon partial axial collapse of the sections.

The U.S. Pat. No. 4,563,104 patent discloses a disposable liquid dispensing pipette which delivers an accurate and uniform drop of liquid of a given size and which incorporates an integral paddle stirrer. The device includes a dispensing tube connected to a flexible and resilient bulb and paddle stirrer. The open end of the tube can be made in various sizes to accommodate different drop sizes.

The U.S. Pat. No. 4,483,825 patent discloses a pipette having a liquid receiving hollow generally encompassed by deformable sidewalls. The pipette further has a tapered liquid outlet extending from one end of the hollow and a liquid inlet on the other end of the hollow within which is located a semi-permeable filter.

For background purposes and as indicative of the art to which the invention is related reference may be made to the remaining cited patents.

| U.S. Pat. No. | INVENTOR | ISSUED |
|---|---|---|
| 6,117,394 | Smith | September 2000 |
| 5,927,884 | Kao | July 1999 |
| 5,702,035 | Tsao | December 1997 |
| 4,779,768 | St. Amand | October 1988 |
| 3,951,313 | Coniglione | April 1976 |
| 3,792,699 | Tobin | February 1974 |
| 3,495,917 | Truhan | February 1970 |

DISCLOSURE OF THE INVENTION

The prior art pipettes include a hollow bulb having an upper end, a lower end and is dimensioned to contain a medicinal product. From the lower end of the bulb extends outward a medication transfer tube having a lower end from where the medicinal product is initially filled and subsequently released when the bulb is squeezed. The filled prior art pipettes are not easily handled and manipulated for further processing or use, such as for placing them on filling racks, adding applicators, labeling, and packaging because the bulb, which is typically used to grasp the pipette, is easily deformed which can cause the medicinal product to flow out the medication transfer tube. The grasping of the pipette by means of the medication transfer tube also presents a problem because the mass center of the pre-filled pipette is located on the bulb which causes an unbalance when the pipette is lifted by the tube.

The sealable and manipulable pre-filled disposable pipette provides an improvement over prior art designs by adding additional structure to the pipette in the form of a primary grasping tab, a secondary grasping tab, and a support tab. The primary grasping tab extends outward from the upper end of the hollow tube; the secondary grasping tab has a first section, a second section, an upper edge and a lower edge, each section is attached to an opposite side of the medication transfer tube with the upper edge of the tab attached to the lower end of the bulb; the support tab has a first section, a second section, an upper edge and a lower edge, the two sections are also attached to opposite sides of the medication transfer tube with the upper edge of the support tab spaced apart from the lower edge of the secondary grasping tab, and with the lower edge of the support tab adjacent the lower edge of the medication transfer tube.

By utilizing the primary grasping tab, either alone or in combination with the secondary grasping tab, a medical practitioner is able to conveniently carry or otherwise handle the pre-filled pipette without inadvertently releasing any of the medicinal product. The support tab is specifically designed to allow the pipette to be hung and held within a conveyer rack apparatus from where the pipette can be automatically filled. After filling, the pipette, while still hanging from the conveyer rack apparatus, can be sealed by means of a cap or a heat-applied foil. After the filling and capping operations the pipette is removed from the apparatus by utilizing the primary tab and/or the secondary tab.

In view of the above disclosure, it is the primary object of the invention to produce a pipette that can be conveniently and easily handled without inadvertently releasing any of the medicinal product.

It is also an object of the invention to produce a pipette that:

Can be easily racked and automatically filled.

Can be designed in various sizes.

Is hygienic.

Is cost effective from both a manufacturing and consumer points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
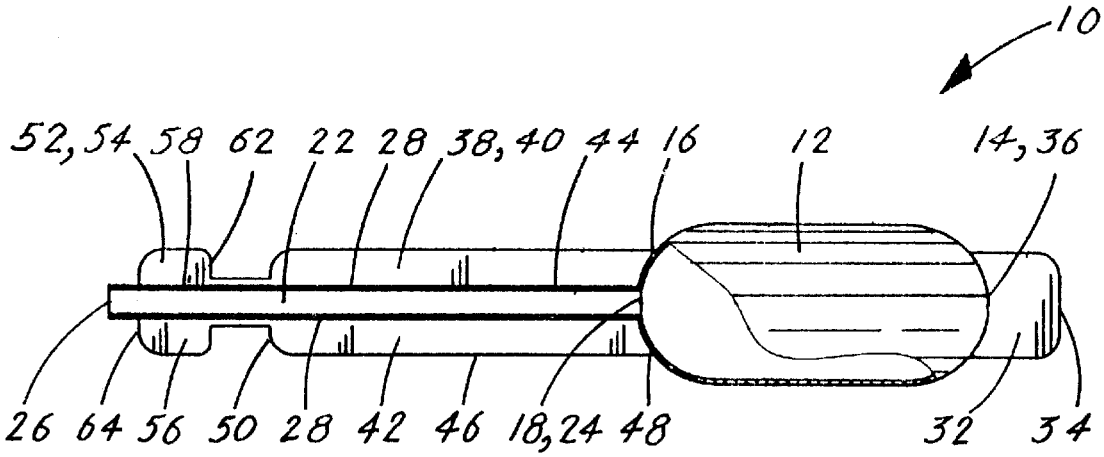
FIG. 1 is a side elevational view of a sealable and manipulable pre-filled disposable pipette showing the relative locations of the inventive primary grasping tab, secondary grasping tab and the support tab.

The best mode for carrying out the invention is presented in terms of a preferred embodiment for a sealable and manipulable pre-filled disposable pipette 10, hereinafter "pipette 10". The pipette 10 is designed to contain and release a medicinal liquid product selected from a group consisting of an aqueous solution, an oil, a solvent, an emulsion, a cream, an ointment, a lotion, a paste, a jelly and a balm.

The preferred embodiment, as shown in FIGS. 1–6, is comprised of the following major elements a hollow bulb 12, a medication transfer tube 22, a primary grasping tab 32, a secondary grasping tab 38, a support tab 52, and a pipette sealing and unsealing means 68. All the elements of the pipette 10 are constructed of a thermoplastic selected from a group consisting of a polycarbonate, polyethylene, polyester, polystyrene, polypropylene, polysulfone, polyurethane and ethylene-vinyl-acetate.

Figure 2:
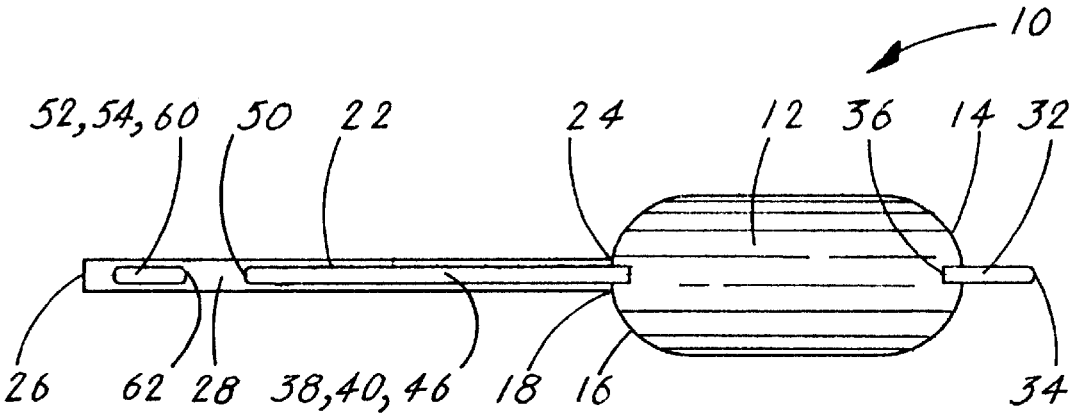
FIG. 2 is a top plan view of the pipette shown in FIG. 1.
Figure 3:
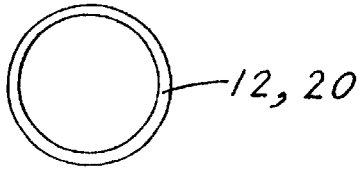
FIG. 3 is an end view of a hollow bulb having a circular shape.

The hollow bulb 12, as best shown in FIGS. 1 and 2, is dimensioned to enclose the medicinal product and structurally includes an upper end 14, and a lower end 16 which has a substantially centered the tube opening 18. The preferred cross-section of the bulb 12 is round, as shown in FIG. 3, however other polygonal shapes can also be used. Likewise, the upper and lower ends 14, 16, of the bulb are preferably radiused, as shown in FIGS. 1 and 2.

The medication transfer tube 22, as also best shown in FIGS. 1 and 2, includes an upper end 24, a lower end 26 and sides 28. The upper end 24 is integrally attached to the bulb opening located on the hollow bulb 12. Thus, a liquid passage is provided from the bulb 12 through the medication transfer tube 22. The internal diameter of the medication transfer tube 22 is at least two times smaller than the internal diameter of the bulb 12.

The primary focus of the invention is centered on the primary grasping tab 32, the secondary grasping tab 38 and the support tab 52. All the tabs are best shown in FIGS. 1 and 2.

The primary grasping tab 32 includes an upper edge 34 and a lower edge 36, wherein the lower edge 36 is shaped to conform and be integrally attached to the upper end 14 of the bulb 12. The tab 32 is shaped and dimensioned to allow the tab to be easily grasped by two fingers. Thus, allowing the pipette 10 to be carried without having to touch the sensitive bulb 12 or the medication transfer tube 22.

The secondary grasping tab 38 includes a first section 40 and a second section 42, wherein each section further includes an inner edge 44, an outer edge 46, an upper edge 48 and a lower edge 50. The two inner edges 44 are radially separated by 180-degrees and are integrally attached to the opposite sides of the medication transfer tube 22. Likewise, the upper edges 48 are shaped and are integrally attached to the lower end 16 of the hollow bulb 12.

The support tab 52 includes a first section 54 and a second section 56, wherein each section further includes an inner edge 58, an outer edge 60, a flat upper edge 62 and a lower edge 64. The two inner edges 58 are radially separated by 180-degrees and are integrally attached to the opposite sides of the medication transfer tube 22 in alignment with the first and second sections 40, 42 of the secondary grasping tab 38. The two flat upper edges 62 are spaced apart from the respective lower edges 50 of the secondary grasping tab 38 and the two lower edges 64 are substantially adjacent the lower end 26 of the medication transfer tube 22.

Figure 6:
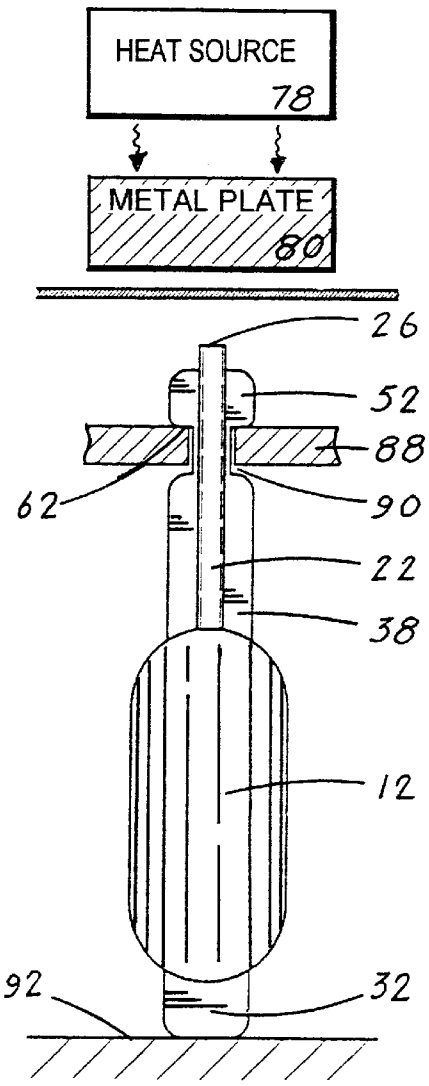
FIG. 6 is a side elevational view of a pipette attached to a conveyer rack apparatus with a sealing means utilizing a foil-sealing technology.
Figure 5:
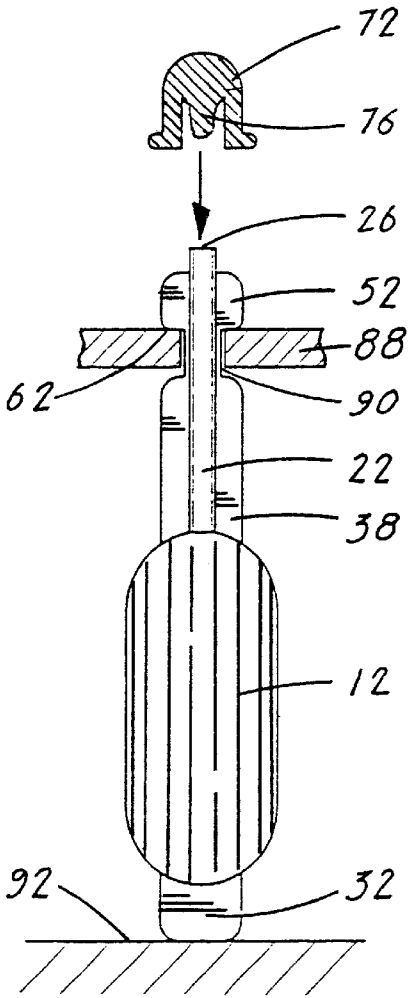
FIG. 5 a side elevational view of a pipette attached to conveyer rack apparatus with a sealing means consisting of a sealing cap having a central plug.
Figure 4:
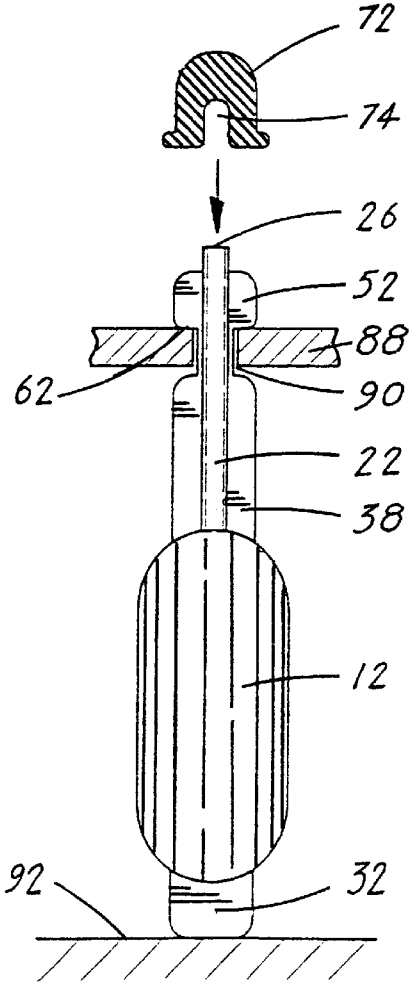
FIG. 4 is a side elevational view of a pipette attached to a conveyer rack apparatus from where the pipette is filled with a medicinal product and handled for further process after filling. The FIGURE also shows a pipette sealing means consisting of a sealing cap having a central cavity.

The final element that comprises the invention is a pipette sealing and unsealing means 68 which is comprised of two cap designs and a foil-sealing technology . The first cap design 72, as shown in FIG. 4, has a central cavity 74 that is shaped and dimensioned to frictionally fit over the lower end 26 of the medication transfer tube 22. The second cap design 72, as shown in FIG. 5, has a cavity from where extends outward a central plug 76 shaped and dimensioned to fit into the opening 30 on the lower end 26 of the medication transfer tube 22. The foil heating technology, as shown in FIG. 6, is typically comprised of:

a) a heat source 78, b) a metal plate 80 having means for receiving heat from the heat source 78, and c) a foil 82 that is heated by the metal plate 80 and subsequently pressed onto the lower end 26 of the medication transfer tube 22.

Prior to sealing the pipette 10, it is necessary to fill the pipette 10 with the medicinal product, which with the prior art pipette designs. has been a problem. By using the primary grasping tab 32, in combination with the secondary grasping tab 38 and the support tab 52 the pipette filling operation is.

facilitated by. allowing the pipette 10 to be safely and easily handled. As shown in FIGS. 4–6, to perform a filling and sealing operation, a conveyor rack apparatus 88 can be employed. To use the apparatus 88, the pipette 10 is initially grasped and handled by using the support tab 52 in combination with the primary and/or secondary grasping 32,38. The pipette is then placed into a conveyor rack opening 90 with the flat upper edge 62 of the support tab 52 resting on the surface of the conveyor rack apparatus 88 thus, allowing the pipette 10 to hang downward with its lower end 26 in position to receive a selected quantity of the medicinal product. To add additional support to the pipette being filled, the conveyer rack apparatus 88 can be designed to include an adjustable support base 92, as also shown in FIGS. 4, 5 and 6. To use the support base 92 it is adjusted to interface with the upper edge 34 of the primary grasping tab. After the filling operation has been completed the medication transfer tube is sealed as described supra.

While the invention has been described in complete detail and pictorially shown in the accompanying drawings it is not to be limited to such details, since many changes and modifications may be made in the invention without departing from the spirit and scope thereof. Hence, it is described to cover any and all modifications and form that may come within the language and scope of the appended claims.

What is claimed is:

1. An improved pre-filled disposable pipette consisting of a hollow bulb dimensioned to enclose a medicinal product and having an upper end and a lower end, wherein to the lower end is integrally attached a medication transfer tube, said improvement comprising:

a) a primary grasping tab having an upper edge and a lower edge, wherein the lower edge is integrally attached to the upper end of the hollow bulb, b) a secondary grasping tab having a first section and a second section, wherein each section has an inner edge, an outer edge, an upper edge, and a lower edge, wherein the two inner edges are attached to opposite sides of the medication transfer tube and the upper edges are integrally attached to the lower end of the hollow bulb, c) a support tab having a first section and a second section, wherein each section has an inner edge, an outer edge, an upper edge, and a lower edge, wherein the two inner edges-are attached to opposite surfaces of the medication transfer tube and the two upper edges are spaced apart from the respective lower edges of said secondary grasping tab and d) means for sealing and unsealing the medicinal product contained within said pipette.

2. The pipette as specified in claim 1 wherein the elements of said pipette are constructed of a thermoplastic, selected from a group consisting of polycarbonate, polyethylene, polyester, polystyrene, polypropylene, polysulfone, polyurethane and ethylene-vinyl-acetate.

3. The pipette as specified in claim 1 wherein said primary grasping tab is dimensioned to allow the tab to be easily grasped by two fingers.

4. The pipette as specified in claim 3 wherein the first and second sections of said secondary grasping tab are dimensioned to allow the two sections to be easily grasped by two fingers, and when grasped in combination with the grasping of said primary grasping tab said pipette can be easily manipulated.

5. The pipette as specified in claim 1 wherein said means for sealing and unsealing the medication product within said pipette comprises a cap having a central cavity dimensioned to frictionally fit over the lower end of said medication transfer tubed.

6. The pipette as specified in claim 1 wherein said means for sealing and unsealing the medication product within said pipette comprises a cap having a central cavity dimensioned to frictionally fit over the lower end of said medication transfer tube.

7. The pipette as specified in claim 1 wherein said means for sealing and unsealing the medication product utilizes a foil-sealing technology comprising:

a) a heat source, b) a flat metal plate having means for receiving heat from said heat source, and c) a foil that is heated by said flat metal plate and subsequently pressed and molded over the lower end of said medication transfer tube.

8. The pipette as specified in claim 1 further comprising a means for filling said pipette with the medication product.

9. A sealable and manipulable pre-filled disposable pipette comprising:

a) a hollow bulb dimensioned to enclose a medicinal product, and having an upper end and a lower end, with the lower end having a substantially centered tube opening, b) a medication transfer tube having an upper end, a lower end and sides, wherein the upper end is integrally attached to the tube opening on said hollow bulb, c) an primary grasping tab having an upper edge and a lower edge, wherein the lower edge is shaped to integrally be attached to the upper end on said hollow bulb, d) a secondary grasping tab having a first section and a second section, wherein each section has an inner edge, an outer edge, an upper edge and a lower edge, wherein the two inner edges are radially separated by 180 degrees and are integrally attached to the opposite sides of said medication transfer tube, and wherein the upper edges are integrally attached to the lower end of said hollow bulb, e) a support tab having a first section and a second section, wherein each section has an inner edge, an outer edge, a flat upper edge and a lower edge, wherein the two inner edges are radially separated by 180 degrees and are integrally attached to the opposite sides of said medication transfer tube, wherein the two flat upper edges are spaced apart from the respective lower edges of said secondary grasping tab, and the two lower edges are substantially adjacent the lower end of said medication transfer tube, and f) means for sealing and unsealing the medication product enclosed within said pipette.

10. The pipette as specified in claim 9 wherein the elements of said pipette are constructed of a thermoplastic selected from a group consisting of polycarbonate, polyethylene, polyester, polystyrene, polypropylene, polysulfone, polyurethane and ethylene-vinyl-acetate.

11. The pipette as specified in claim 9 wherein said medication product comprises a liquid selected from a group consisting of an aqueous solution, oil, solvent, emulsion, cream ointment, lotion, paste, jelly and balm.

12. The pipette as specified in claim 9 wherein the cross-section of said bulb is preferably round.

13. The pipette as specified in claim 9 wherein the upper end and the lower end of said hollow bulb is radiused.

14. The pipette as specified in claim 9 wherein the internal diameter of said medication transfer tube is at least two times smaller than the internal diameter of said hollow bulb.

15. The pipette as specified in claim 9 wherein said primary grasping tab is shaped and dimensioned to allow the tab to be easily grasped by two fingers.

16. The pipette as specified in claim 15 wherein the first and second sections of said secondary grasping tab are dimensioned to allow the two sections to be easily grasped by two fingers, and when grasped in combination with the grasping of said primary grasping tab said pipette can be easily manipulation.

17. The pipette as specified in claim 9 wherein said means for sealing and unsealing the medication product within said pipette comprises a cap having a central cavity that is shaped and dimensioned to frictionally fit over the lower end of said medication transfer tube.

18. The pipette as specified in claim 9 wherein said means for sealing and unsealing the medication product within said pipette comprises a cap having a cavity where extends outward a central plug that is shaped and dimensioned to frictionally fit into the opening on the lower end of said medication transfer tube.

19. The pipette as specified in claim 9 wherein said means for sealing and unsealing the medication product utilizes a foil-sealing technology comprising:

a) a heat source, b) a metal plate having means for receiving heat from said heat source, and c) a foil that is heated by said metal plate and subsequently pressed onto the lower end of said medication transport tube.

20. The pipette as specified in claim 9 further comprising a means for filling said pipette with the medication product.

21. The pipette as specified in claim 20 wherein said pipette filling means comprises a conveyor rack apparatus that is designed to allow said pipette to hang downward when said support tab is inserted into an opening on the apparatus with the flat upper edge of said support tab resting on the surface of the conveyer rack apparatus, wherein when said pipette is attached, the lower end of said medication transfer tube is positioned to receive a selected quantity of the medication product and to perform the sealing operation.

22. The pipette as specified in claim 21 wherein said conveyor rack apparatus further comprises an adjustable support base, which is adjusted to interface with the upper edge of said primary grasping tab.

* * * * *